US011746798B2

(12) United States Patent
Hsu et al.

(10) Patent No.: US 11,746,798 B2
(45) Date of Patent: Sep. 5, 2023

(54) CENTRIFUGAL FAN

(71) Applicant: Delta Electronics, Inc., Taoyuan (TW)

(72) Inventors: Kuo-Tung Hsu, Taoyuan (TW); Shun-Chen Chang, Taoyuan (TW); Wen-Chun Hsu, Taoyuan (TW); Chao-Fu Yang, Taoyuan (TW); Shuo-Sheng Hsu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 17/533,413

(22) Filed: Nov. 23, 2021

(65) Prior Publication Data

US 2022/0163051 A1 May 26, 2022

Related U.S. Application Data

(60) Provisional application No. 63/117,634, filed on Nov. 24, 2020.

(51) Int. Cl.
*F04D 29/42* (2006.01)
*F04D 29/70* (2006.01)
*F04D 17/08* (2006.01)

(52) U.S. Cl.
CPC ..... *F04D 29/4226* (2013.01); *F04D 17/08* (2013.01); *F04D 29/703* (2013.01)

(58) Field of Classification Search
CPC .. F04D 29/4226; F04D 29/703; F04D 29/464; F04D 29/422; F04D 29/4206;
(Continued)

(56) References Cited

U.S. PATENT DOCUMENTS 5,938,527 A * 8/1999 Oshima ..... F24F 1/01 454/344
7,497,659 B2 3/2009 Hsu et al.
(Continued)

FOREIGN PATENT DOCUMENTS

CN 202867341 U 4/2013
CN 105003456 A 10/2015
(Continued)

OTHER PUBLICATIONS

Espacenet translation of CN-106640766-A (Year: 2017).*

*Primary Examiner* — Christopher Verdier
*Assistant Examiner* — Ryan C Clark
(74) *Attorney, Agent, or Firm* — KIRTON McCONKIE; Evan R. Witt

(57) ABSTRACT

A centrifugal fan is disclosed and includes a lower case, an impeller and an upper case. The lower case includes a bottom plate and a sidewall. The impeller is disposed on the bottom plate. The upper case is assembled with the sidewall to form an outlet. The upper case is formed by stamping and includes a first plane, an inlet and a grille. When the impeller is rotated, an airflow flowing from the inlet to the outlet is formed. The grille is protruded outwardly from the first plane, and includes a connecting frame and plural ribs. A spacing height is formed between the connecting frame and the inlet. Each rib has a first end connected to the connecting frame and a second end connected to the first plane. A pair of notches are disposed adjacent to two opposite lateral edges of the second end of the corresponding rib, respectively.

19 Claims, 14 Drawing Sheets

(58) Field of Classification Search
CPC ..... F04D 29/403; F04D 17/08; F04D 17/16; H05K 7/20172; H05K 7/20145; G06F 1/20; G06F 1/203
See application file for complete search history.

(56) References Cited

U.S. PATENT DOCUMENTS

| | | | | |
|---|---|---|---|---|
| 10,371,161 | B2 | 8/2019 | Ling et al. | |
| 2004/0191072 | A1* | 9/2004 | Garnett | F04D 29/703 416/247 R |
| 2004/0197189 | A1* | 10/2004 | Seo | F04D 29/703 415/121.2 |
| 2006/0153674 | A1* | 7/2006 | Kamoshita | F04D 29/4213 415/119 |
| 2010/0329857 | A1* | 12/2010 | Heli | F04D 29/626 415/182.1 |
| 2014/0154095 | A1* | 6/2014 | Gonz Lez | F24F 1/38 416/247 R |
| 2015/0104294 | A1* | 4/2015 | Hustvedt | F04D 29/663 415/119 |
| 2016/0017892 | A1* | 1/2016 | Fujisono | F04D 29/162 415/204 |
| 2016/0025103 | A1* | 1/2016 | Fujimoto | F04D 17/08 415/203 |
| 2016/0264028 | A1* | 9/2016 | Kawashima | F04D 29/281 |
| 2017/0114803 | A1* | 4/2017 | Miwa | H05K 7/20145 |
| 2017/0241443 | A1* | 8/2017 | Takashima | F04D 29/703 |
| 2018/0202457 | A1* | 7/2018 | Tamaoka | F04D 29/30 |
| 2019/0003491 | A1 | 1/2019 | Lofy et al. | |
| 2019/0301485 | A1* | 10/2019 | Chen | F04D 25/08 |
| 2019/0376522 | A1* | 12/2019 | Liu | F04D 29/422 |
| 2019/0389345 | A1* | 12/2019 | Kim | F04D 29/4226 |
| 2020/0200187 | A1* | 6/2020 | Weinzierl | F04D 29/4213 |
| 2020/0392966 | A1* | 12/2020 | Anschütz | F04D 29/4226 |
| 2021/0095679 | A1* | 4/2021 | Uchino | F04D 25/0693 |
| 2021/0095693 | A1* | 4/2021 | Uchino | F04D 29/281 |

FOREIGN PATENT DOCUMENTS

| | | | | |
|---|---|---|---|---|
| CN | 106640766 | A * | 5/2017 | F04D 25/08 |
| CN | 105221483 | B | 11/2017 | |
| DE | 102017107652 | A1 * | 10/2017 | F04D 17/16 |
| TW | I611954 | B | 1/2018 | |

* cited by examiner

CENTRIFUGAL FAN

CROSS REFERENCE TO RELATED APPLICATION

The application claims the benefit of U.S. Provisional Application Ser. No. 63/117,634 entitled "BLOWER HAVING AN INLET GRILLE STRUCTURE," filed Nov. 24, 2020. The subject matter of all of the foregoing disclosure is incorporated herein by reference.

FIELD OF THE INVENTION

The present disclosure relates to a centrifugal fan, and more particularly to a centrifugal fan having a grille, which is formed outside an inlet by stamping an upper case, so as to protect an impeller having a hub higher than a bottom surface of the upper case.

BACKGROUND OF THE INVENTION

A centrifugal fan is used to drive an airflow to change the flowing direction, so that the discharged air is guided toward a specific direction or flows through a heat dissipation device. However, as electronic products tend to be thinner and more high-performance development requirements, in many application environments, the centrifugal fan must not only meet the basic heat dissipation requirements, but also need to further pursue "thinning". Therefore, reducing the axial height of the centrifugal fan becomes an important development trend. The centrifugal fan includes a fan frame, a stator assembly and an impeller. The stator assembly is assembled in the fan frame, and the impeller is rotatably disposed in the fan frame. When the height of the fan frame of the centrifugal fan approaches the height of the hub of the impeller for reducing the axial height, it is necessary to consider the misalignment of the hub and the inlet. Moreover, the problems of foreign objects intruding into the fan, interference and abnormal sound have to be avoided at the same time.

Therefore, there is a need of providing a centrifugal fan having a grille, which is formed outside an inlet by stamping an upper case, so as to protect an impeller having a hub higher than a bottom surface of the upper case, and meet the requirements of the application environments.

SUMMARY OF THE INVENTION

An object of the present disclosure is to provide a centrifugal fan having a grille. The grille is formed outside an inlet by stamping an upper case, so as to protect an impeller having a hub higher than a bottom surface of the upper case. The grille is formed by the combination of a connecting frame and a plurality of ribs. The connecting frame has a horizontal projection located within the inlet, and is corresponding to the inlet and blades of the impeller, and convexly formed to form a spacing height to protect the hub of the impeller higher than the bottom surface of the upper case. In addition, the connecting frame is connected to the upper case through at least three ribs to provide the sufficient compressive strength and increase the reliability of the product. Moreover, when the plurality of ribs are designed asymmetrically, the blade-passage frequency (BPF) is further dispersed and the generation of high-frequency noise is reduced. On the other hand, the part of the fan frame corresponding to the outlet is designed in an inclined type, a convex type or a stepped type, so that the outlet height of the centrifugal fan is formed less than the fan-frame height of the centrifugal fan. It facilitates to increase the airflow pressure and reduce the turbulence area under the impeller. Furthermore, a wind-guiding plate and additional notches recessed thereon are disposed and corresponding to the outlet so as to provide the wind-guiding function and the noise reduction function, respectively.

Another object of the present disclosure is to provide a centrifugal fan having a grille. An upper case, an inlet and the grille are integrally formed by stamping a metal material, and further combined with a plastic lower case through for example injection molding so as to simplify the assembly process. Since the grille is stamped and formed by the metal material, it easy to change the combinations of the connecting frame and the plurality of ribs, increase the diversion variations of the inlet, ensure the compressive strength of the grille, and achieve the purpose of reducing noise. Furthermore, a pair of notches are disposed at the positions where each bent rib is connected to the upper case. When the upper case is stamped to form the connecting frame and the plurality of ribs of the grille, a sufficient structural strength is maintained between the plurality of ribs and the first plane. It facilitates to increase the dimensional stability of the formation, and avoid the deformation of the plurality of ribs and the first plane due to the stamping operation. Certainly, the aforementioned technical features of the centrifugal fan of the present disclosure can be combined and adjustable according to the practical requirements.

In accordance with an aspect of the present disclosure, a centrifugal fan is provided and includes a lower case, an impeller and an upper case. The lower case includes a bottom plate and a sidewall, wherein the sidewall is connected to the bottom plate. The impeller is disposed on the bottom plate. The upper case is assembled with the sidewall of the lower case to form an outlet located between the upper case and the bottom plate, wherein the upper case is formed by stamping a metal material and includes a first plane, an inlet and a grille, the inlet is passed through the first plane and spatially corresponding to the impeller, and when the impeller is rotated, an airflow flowing from the inlet to the outlet is formed, wherein the grille is protruded outwardly from the first plane, spatially corresponding to the inlet, and includes at least one connecting frame and a plurality of ribs, wherein a spacing height is formed between the at least one connecting frame and the inlet, and a horizontal projection of the at least one connecting frame is located within a range of the inlet, wherein each of the plurality of ribs has a first end connected to the at least one connecting frame and a second end connected to the first plane, and a pair of notches are formed and corresponding thereto, wherein the pair of notches are located at the first plane and disposed adjacent to two opposite lateral edges of the second end of the corresponding rib, respectively.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

Figure 1:
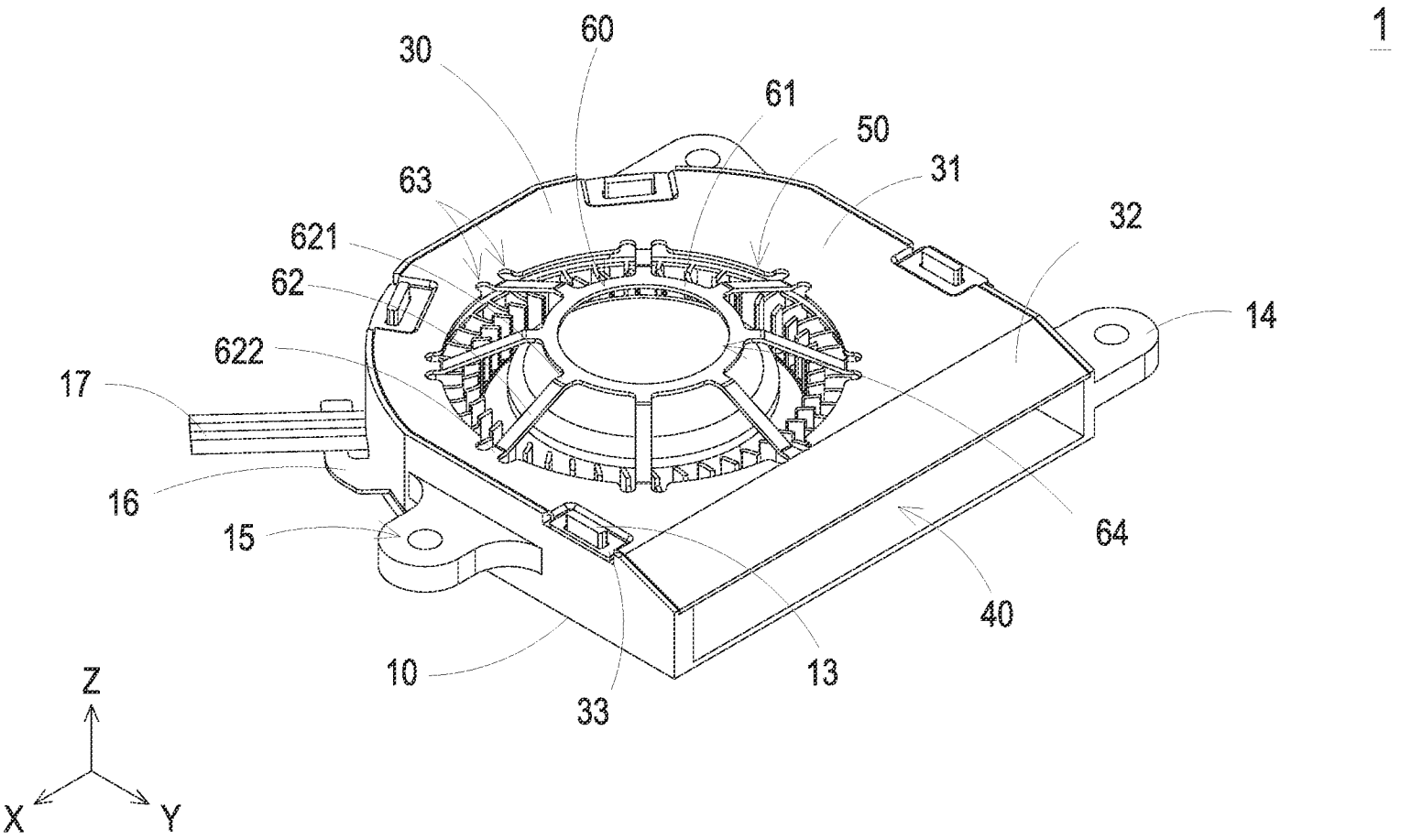
FIG. 1 is a perspective view illustrating a centrifugal fan according to a first embodiment of the present disclosure.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed. Further, spatially relative terms, such as "outwardly," "lower," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. When an element is referred to as being "connected," or "coupled," to another element, it can be directly connected or coupled to the other element or intervening elements may be present. Although the wide numerical ranges and parameters of the present disclosure are approximations, numerical values are set forth in the specific examples as precisely as possible. In addition, although the "first," "second," "third," and the like terms in the claims be used to describe the various elements can be appreciated, these elements should not be limited by these terms, and these elements are described in the respective embodiments are used to express the different reference numerals, these terms are only used to distinguish one element from another element. For example, a first element could be termed a second element, and, similarly, a second element could be termed a first element, without departing from the scope of example embodiments.

FIG. 1 is a perspective view illustrating a centrifugal fan according to a first embodiment of the present disclosure. In the embodiment, the centrifugal fan 1 includes a lower case 10 and an upper case 30 assembled with each other to form a fan frame. Preferably but not exclusively, the lower case 10 and the upper case 30 are assembled with each other through a snap-in method, and an outlet 40 is formed between the lower case 10 and the upper case 30. In the embodiment, the upper case 30 includes a first plane 31, an inlet 50, a grille 60, a second plane 32 and a plurality of fastening plates 33. The inlet 50 is a through hole and passed through the first plane 31. The upper case 30 is formed by stamping a metal material so that the inlet 50 and grille 60 are formed thereby. The grille 60 is protruded outwardly from the first plane 31, and is spatially corresponding to the inlet 50. In the embodiment, the grille 60 includes at least one connecting frame 61 and a plurality of ribs 62. The at least one connecting frame 61 includes an opening 64 spatially corresponding to the inlet 50, and the opening 64 has a horizontal projection located within a range of the inlet 50. Moreover, in the embodiment, each of the plurality of ribs 62 has a first end 621 and a second end 622. The first end 621 of the respective rib 62 is connected to the at least one connecting frame 61. The second end 622 of the respective rib 62 is connected to the first plane 31, and a pair of notches 63 are formed and corresponding thereto. The pair of notches 63 are located at the first plane 31 and disposed adjacent to two opposite lateral edges of the second end 622 of the corresponding rib 62, respectively. When the upper case 30 is stamped to form the connecting frame 61 and the plurality of ribs 62 of the grille 60, a sufficient structural strength is maintained between the plurality of ribs 62 and the first plane 31. It facilitates to increase the dimensional stability of the formation, and avoid the deformation of the plurality of ribs 62 and the first plane 31 due to the stamping operation.

Preferably but not exclusively, in the embodiment, eight elongated ribs 62 with the same size and the same structure are connected between the circular connecting frame 61 and the first plane 31, and the eight elongated ribs 62 are arranged equidistantly around the connecting frame 61. Notably, the number, the type, the size and the arrangement of the connecting frame 61 and the ribs 62 are adjustable according to the practical requirements, and the present disclosure is not limited thereto.

Preferably but not exclusively, in the embodiment, the second plane 32 is an inclined plane, extended from the first plane 31, and inclined toward the lower case 10 in a direction (i. e., the Y-axis direction) from the inlet 50 to the outlet 40. Preferably but not exclusively, the plurality of fastening plates 33 are disposed adjacent to an outer periphery of the upper case 30. In the embodiment, the lower case 10 includes a plurality of protrusions 13 spatially corresponding to the fastening plates 33 on the upper case 30. Each of the protrusions 13 is passed through the corresponding fastening plate 33 and engaged with the corresponding fastening plate 33 through a snap-in method, so as to assemble the lower case 10 and the upper case 30. Certainly, the assembling method of the lower case 10 and the upper case 30 is not limited thereto. Preferably but not exclusively, in the other embodiment, the upper case 30 made of sheet metal and the lower case 10 made of plastic are of different materials, and are combined through an injection molding so as to allow the lower case 10 to be designed for compressing the airflow pressure of the centrifugal fan 1 and converting it into the air volume. It helps to achieve the interface and the structure for a systematic assembling, and the assembly process is simplified.

On the other hand, the centrifugal fan 1 is applied to for example but not limited to air circulation or heat dissipation in the interior space of a vehicle. In the embodiment, the lower case 10 includes a plurality of attachment portions 14 protruded outwardly from the sidewall 12, and each of the attachment portions 14 includes a corresponding screw hole 15. By utilizing a screw (not shown) passed through the screw hole 15 on the respective attachment portion 14, the centrifugal fan 1 is fixed to an object as desired. Certainly, in the present disclosure, the form of fixing the centrifugal fan 1 to the object is not limited thereto. In the embodiment, the lower case 10 further includes a bracket 16, which is configured to fix the power wire 17 of the centrifugal fan 1. Certainly, the present disclosure is not limited thereto, and not redundantly described herein.

Figure 2:
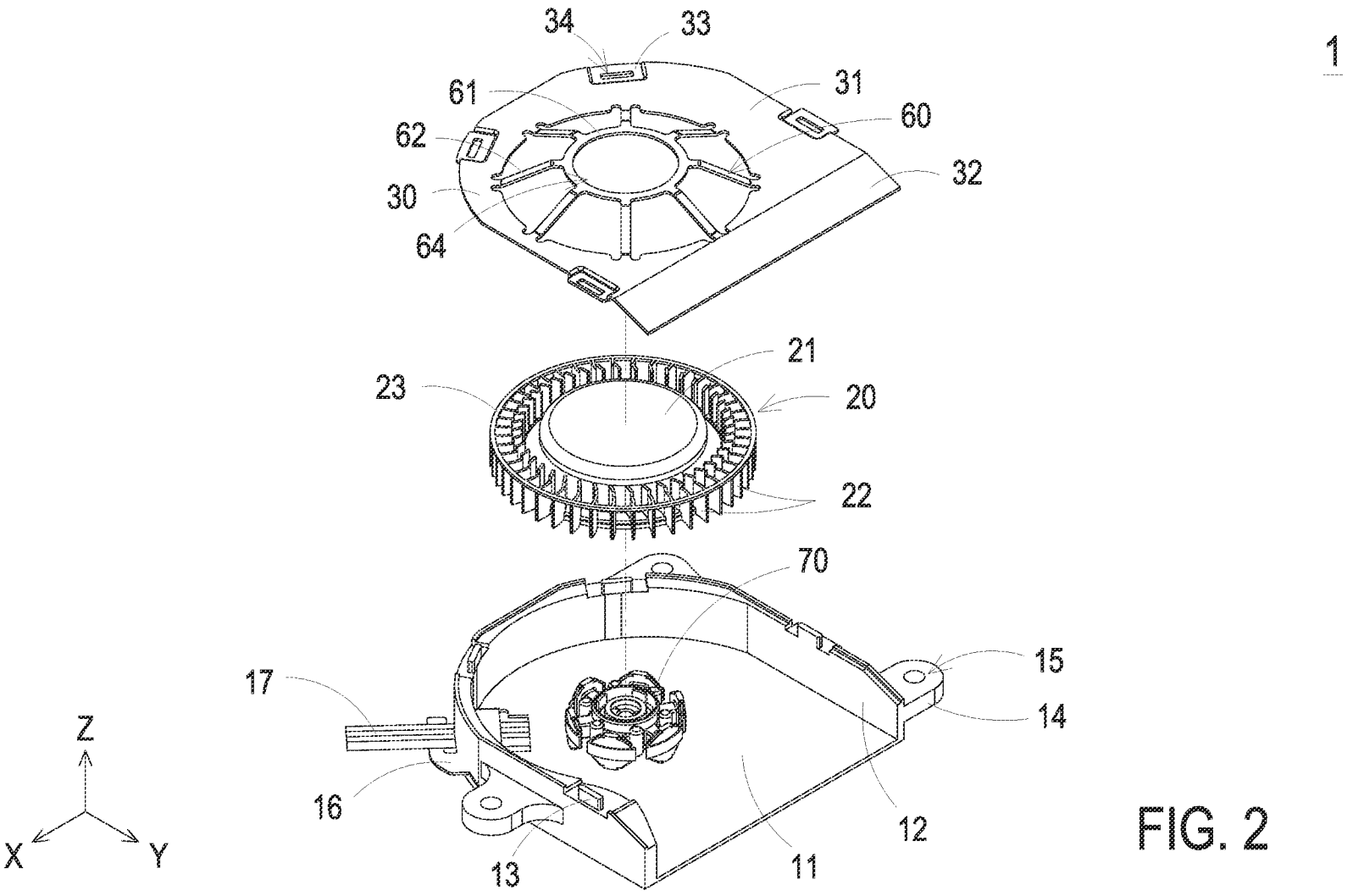
FIG. 2 is an exploded view illustrating the centrifugal fan according to the first embodiment of the present disclosure.

FIG. 2 is an exploded view illustrating the centrifugal fan according to the first embodiment as shown in FIG. 1. In the embodiment, the lower case 10 is integrally formed by for example but not limited to injection molding of a plastic material, and includes a bottom plate 11 and a sidewall 12. The sidewall 12 is connected to an outer periphery of the bottom plate 11. The centrifugal fan 1 includes an impeller 20 and a stator 70 disposed on the bottom plate 11 of the lower case 10. A power wire 17 is connected to the stator 70, and the impeller 20 is sleeved on the stator 70. In the embodiment, the impeller 20 includes a hub 21, a plurality of blades and a connecting ring 23. The plurality of blades 22 are disposed around an outer periphery of the hub 21 and connected to each other through the connecting ring 23. In the embodiment, the inlet 50 and the grille 60 formed on the upper case 30 are spatially corresponding to the impeller 20. When the impeller 20 is rotated, an airflow flowing from the inlet 50 to the outlet 40 is formed.

Preferably but not exclusively, in the embodiment, the plurality of protrusions 13 are disposed on the top portion of the sidewall 12 and spatially corresponding to the fastening holes 34 of the plurality of fastening plates 33. When each of the plurality of protrusions 13 is passed through and engaged with the fastening hole 34 of the corresponding fastening plate 33, the lower case 10 and the upper case 30 are assembled and fastened to each other. The assembling method of the lower case 10 and the upper case 30 is not limited thereto. Preferably but not exclusively, the plurality of attachment portions 14 are protruded outwardly from the sidewall 12, and it facilitates the respective screw (not shown) to pass through corresponding screw holes 15 to fix the centrifugal fan 1 on the object. The bracket 16 is protruded outwardly from the sidewall 12. The power wire 17 is electrically connected to the stator 70 and passed through the sidewall 12. Preferably but not exclusively, in the embodiment, the lower case 10 is formed by injection molding of a plastic material so that the bottom plate 11, the sidewall 12, the protrusions 13, the attachment portions 14 and the bracket 16 are integrally formed into one piece.

Figure 3:
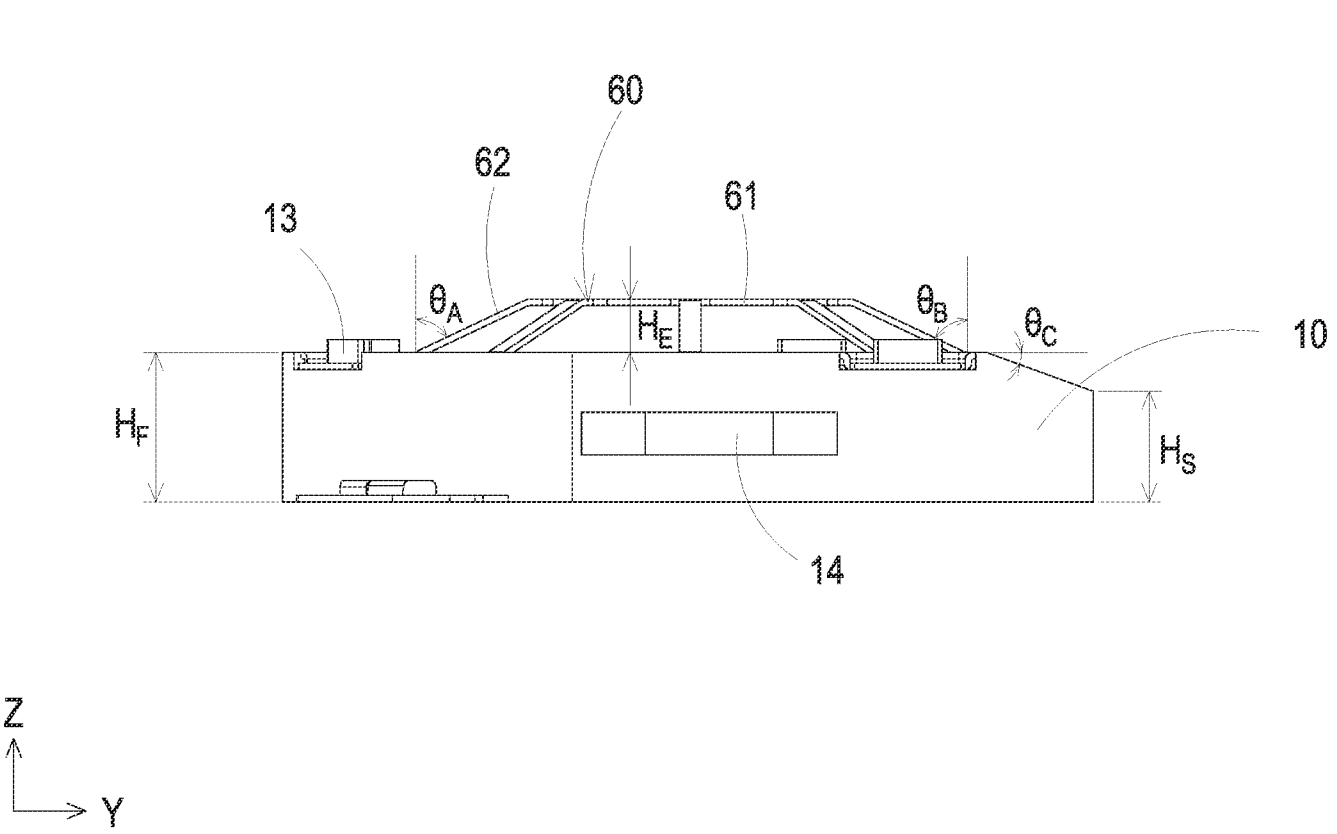
FIG. 3 is a lateral view illustrating the centrifugal fan according to the first embodiment of the present disclosure.

FIG. 3 is a lateral view illustrating the centrifugal fan according to the first embodiment as shown in FIGS. 1 and 2. In the embodiment, the lower case 10 and the upper case 30 are assembled to form a fan-frame height $H_F$. In addition, the grille 60 is protruded outwardly from the first plane 31 of the upper case 30 so that a spacing height $H_E$ is formed between the connecting frame 61 and the inlet 50. Preferably but not exclusively, in the embodiment, the spacing height $H_E$ formed between the connecting frame 61 and the inlet 50 is less than the fan-frame height $H_F$ so as to ensure that a sufficient compressive strength of the grille 60 is achieved through a sheet metal bending structure. Moreover, the reliability of the product is increased, and the purpose of reducing noise is achieved.

Preferably but not exclusively, in the embodiment, the plurality of ribs 62 are connected between the connecting frame 61 and the first plane 31 to form a first bending angle $\theta_A$ and a second bending angle $\theta_B$. In the embodiment, the first bending angle $\theta_A$ and the second bending angle $\theta_B$ are equal to each other and ranged from 0 degree to 90 degrees. Preferably but not exclusively, in other embodiment, the first bending angle $\theta_A$ and the second bending angle $\theta_B$ are unequal. In other words, the plurality of ribs 62 are allowed to be designed asymmetrically, so that the blade-passage frequency (BPF) is further dispersed, and the purpose of optimizing the voice quality is achieved.

Preferably but not exclusively, the second plane 32 extended from the first plane 31 is an inclined plane and forms an inclination angle θC with respect to the first plane 31 arranged horizontally. The inclination angle θC is less than or equal to 75 degrees. In other words, the outlet height $H_S$ formed at the outlet 40 of the centrifugal fan 1 is formed less than the fan-frame height $H_F$. It facilitates to increase the airflow pressure between the second plane 32 and the bottom plate 11 of the lower case 10 toward the outlet 40, and reduce the turbulence area under the impeller 20.

Figure 4:
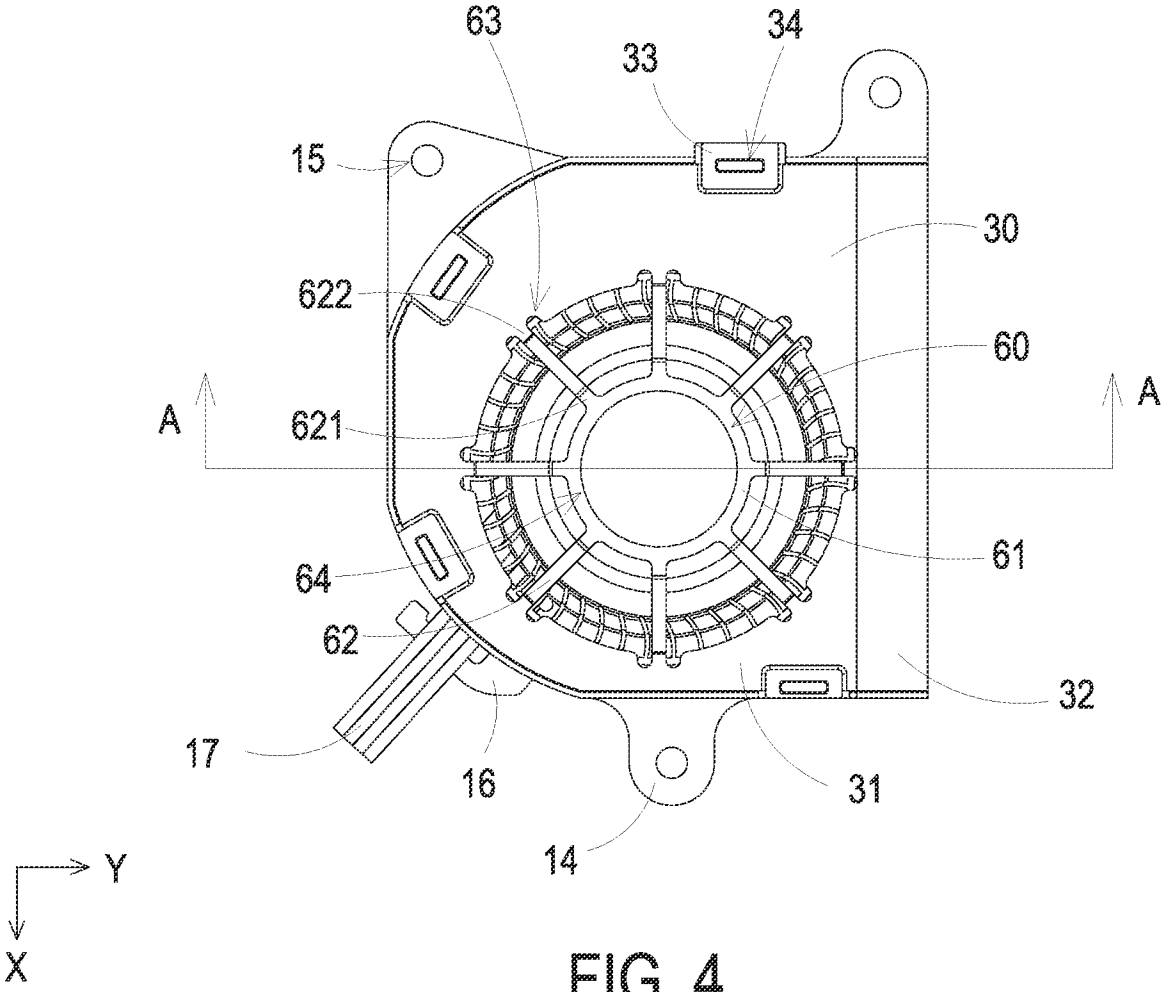
FIG. 4 is a top view illustrating the centrifugal fan according to the first embodiment of the present disclosure.

FIG. 4 is a top view illustrating the centrifugal fan according to the first embodiment as shown in FIGS. 1 to 3. In the embodiment, the grille 60 is spatially corresponding to the inlet 50 and the hub 21 of the impeller 20. Preferably but not exclusively, the horizontal projection of the connecting frame 61 is located within the range of the inlet 50. Since the connecting frame 61 is connected to the first plane 31 of the upper case 30 through at least three ribs 62, it ensures that the structure of the grille 60 provides the sufficient compressive strength, and the reliability of the product is increased. Preferably but not exclusively, in the embodiment, there are eight ribs 62 designed symmetrically. In other embodiment, the grille 60 includes several ribs 62 connected between the connecting frame 61 and the first plane 31 of the upper case 30. Preferably but not exclusively, a number N of the ribs 62 is greater than or equal to 3. Certainly, the number, the type, the size and the arrangement of the ribs 62 of the grille 60 are adjustable according to the practical requirements. Notably, when the plurality of ribs 62 are designed asymmetrically, the blade-passage frequency (BPF) is further dispersed so as to achieve the purpose of optimizing the voice quality. Certainly, the present disclosure is not limited thereto.

Figure 5:
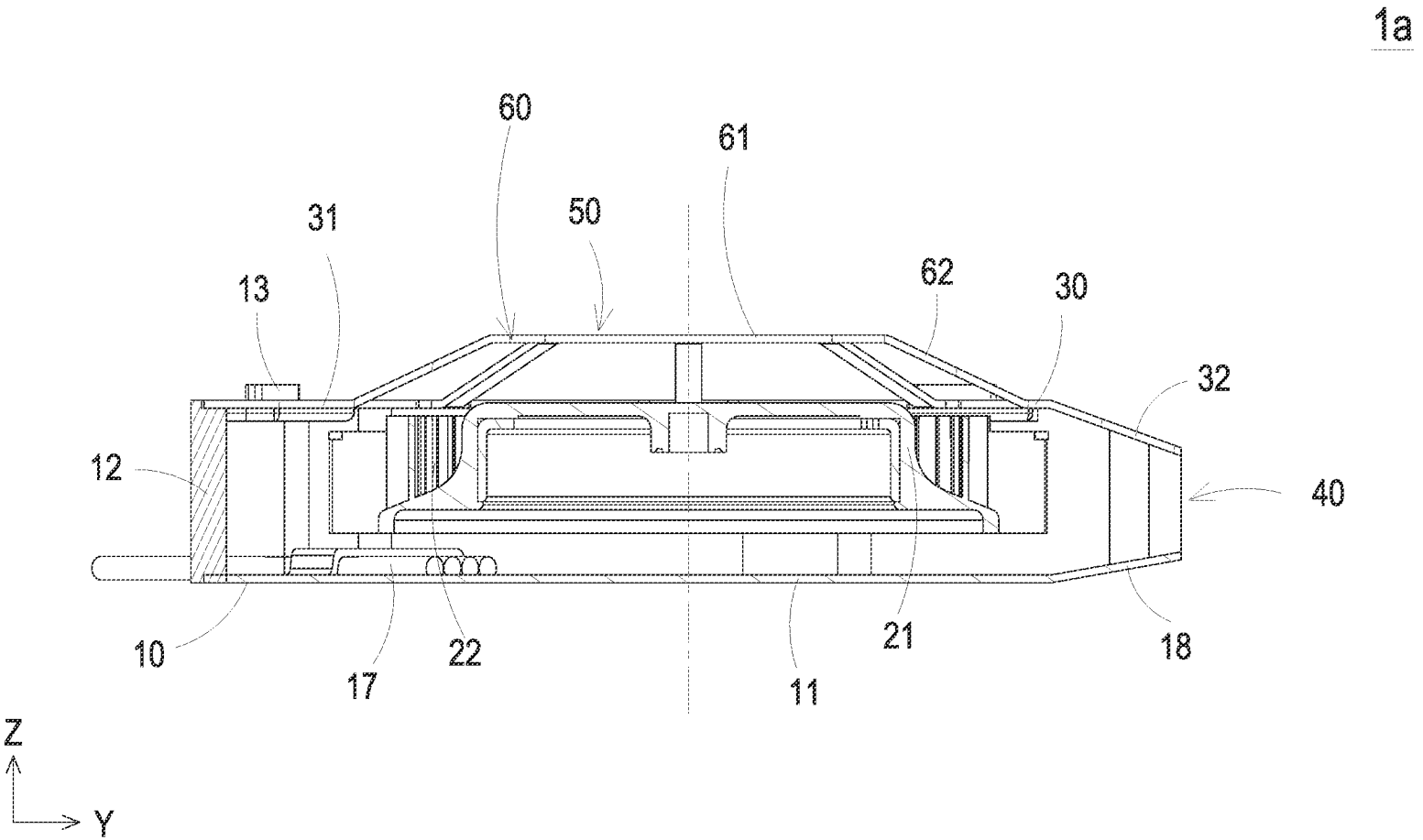
FIG. 5 is a cross-sectional view illustrating a centrifugal fan according to a second embodiment of the present disclosure.

FIG. 5 is a cross-sectional view illustrating a centrifugal fan according to a second embodiment of the present disclosure. The cross-sectional view is taken exemplarily and corresponding to the line $\overline{AA}$ shown in FIG. 4. In the embodiment, the structures, elements and functions of the centrifugal fan 1*a* are similar to those of the centrifugal fan 1 of FIGS. 1 to 4, and are not redundantly described herein. In the embodiment, the lower case 10 further includes an inclined plane 18 spatially corresponding to the second plane 32. Preferably but not exclusively, the inclined plane 18 is extended from the bottom plate 11 and inclined toward the upper case 30 along the direction (i. e., the Y-axis direction) from the inlet 50 to the outlet 40. Thus, the dimension of outlet 40 is reduced and the airflow pressure between the second plane 32 and the inclined plane 18 of the lower case 10 toward the outlet 40 is increased, and the turbulence area under the impeller 20 is reduced.

Notably, in the embodiment, the hub 21 of the impeller 20 is spatially corresponding to the inlet 50 and the grille 60. The vertical height of the top of the hub 21 in the Z-axis direction is higher than the bottom surface of the upper case 30. Therefore, the inlet 50 has to misalign the top of the hub 21 for installation so that the top of the hub 21 is exposed through the inlet 50. In the embodiment, since the grille 60 of the centrifugal fan 1*a* is connected to the upper case 30 and formed outside the inlet 50 through a sheet metal bending structure, it allows the grille 60 to protect the impeller 20 having the hub 21 higher than the bottom surface of the upper case 30, and the connecting frame 61 and the ribs 62 of the grille 60 are kept away from the blades 22 to reduce the noise.

Figure 6:
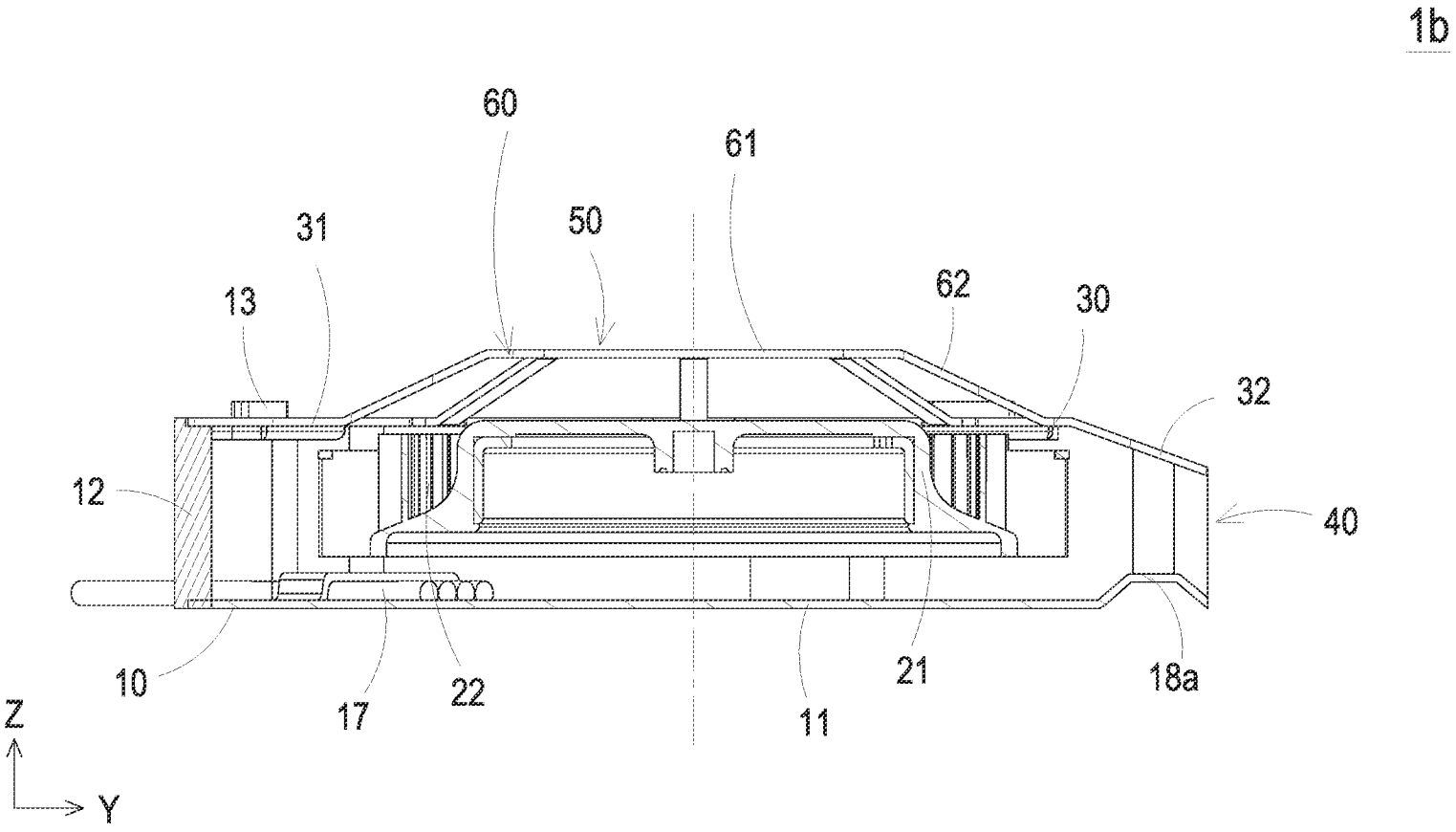
FIG. 6 is a cross-sectional view illustrating a centrifugal fan according to a third embodiment of the present disclosure.

FIG. 6 is a cross-sectional view illustrating a centrifugal fan according to a third embodiment of the present disclosure. The cross-sectional view is taken exemplarily and corresponding to the line $\overline{AA}$ shown in FIG. 4. In the embodiment, the structures, elements and functions of the centrifugal fan 1*b* are similar to those of the centrifugal fan 1 of FIGS. 1 to 4, and are not redundantly described herein. In the embodiment, the lower case 10 further includes a convex structure 18*a* spatially corresponding to the second plane 32. Preferably but not exclusively, the convex structure 18*a* is extended from the bottom plate 11, and a middle section of the convex structure 18*a* is protruded toward the upper case 30 to form a protrusion toward the pathway of airflow from the inlet 50 to the outlet 40. Thus, the airflow pressure between the second plane 32 and the convex structure 18*a* of the lower case 10 toward the outlet 40 is increased, and the turbulence area under the impeller 20 is reduced.

Figure 7:
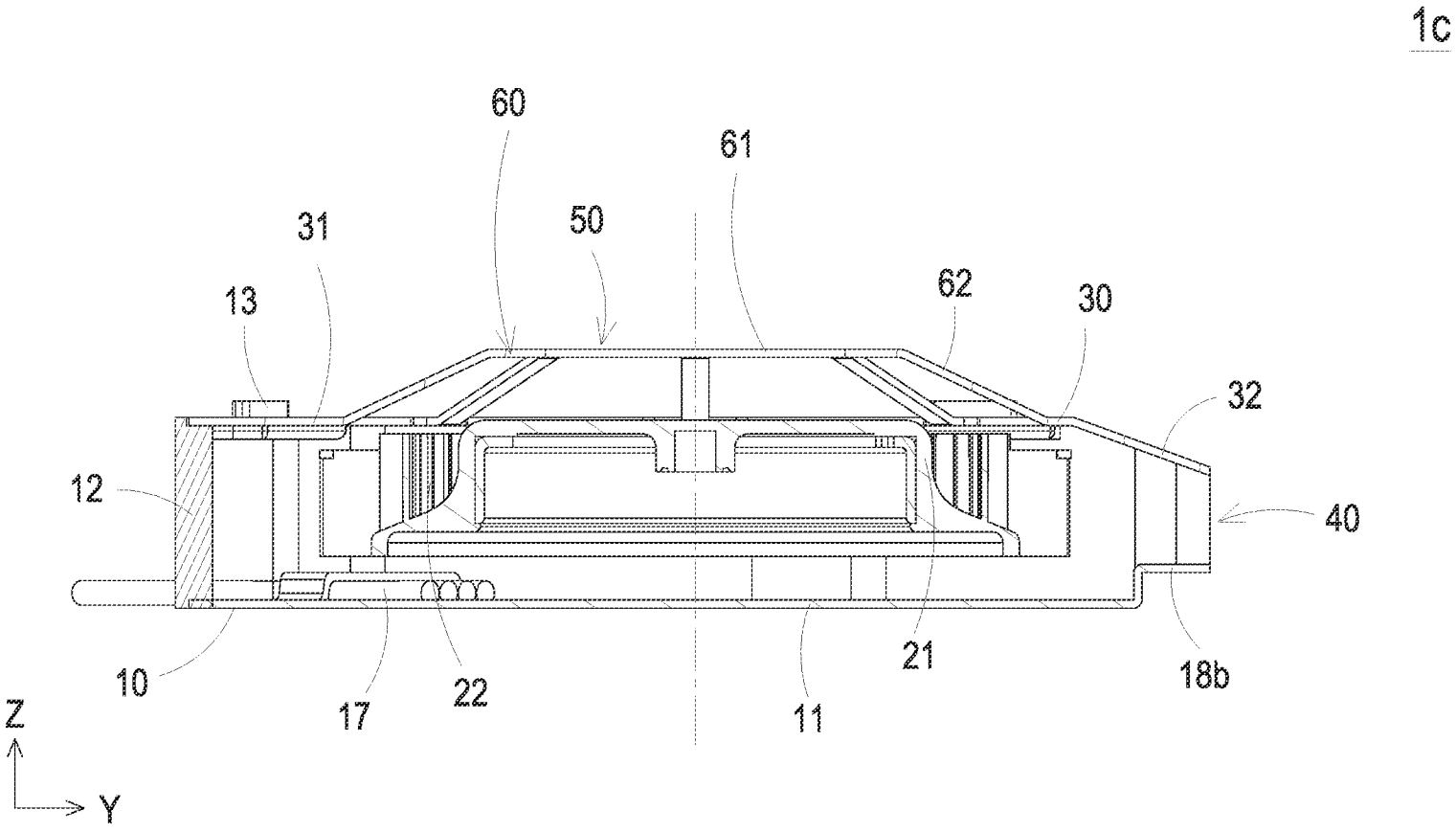
FIG. 7 is a cross-sectional view illustrating a centrifugal fan according to a fourth embodiment of the present disclosure.

FIG. 7 is a cross-sectional view illustrating a centrifugal fan according to a fourth embodiment of the present disclosure. The cross-sectional view is taken exemplarily and corresponding to the line $\overline{AA}$ in FIG. 4. In the embodiment, the structures, elements and functions of the centrifugal fan 1*c* are similar to those of the centrifugal fan 1 of FIGS. 1 to 4, and are not redundantly described herein. In the embodiment, the lower case 10 further includes a stepped structure 18*b* spatially corresponding to the second plane 32. Preferably but not exclusively, the stepped structure 18*b* is extended from the bottom plate 11, and the stepped structure 18*b* is close to the second plane 32 of the upper case 30 relative to the bottom plate 11 so that a protrusion-like structure is formed near the outlet 40 to reduce the dimension of the pathway of airflow from the inlet 50 to the outlet 40. Thus, the airflow pressure between the second plane 32 and the stepped structure 18*b* of the lower case 10 toward the outlet 40 is increased, and the turbulence area under the impeller 20 is reduced.

Figure 8:
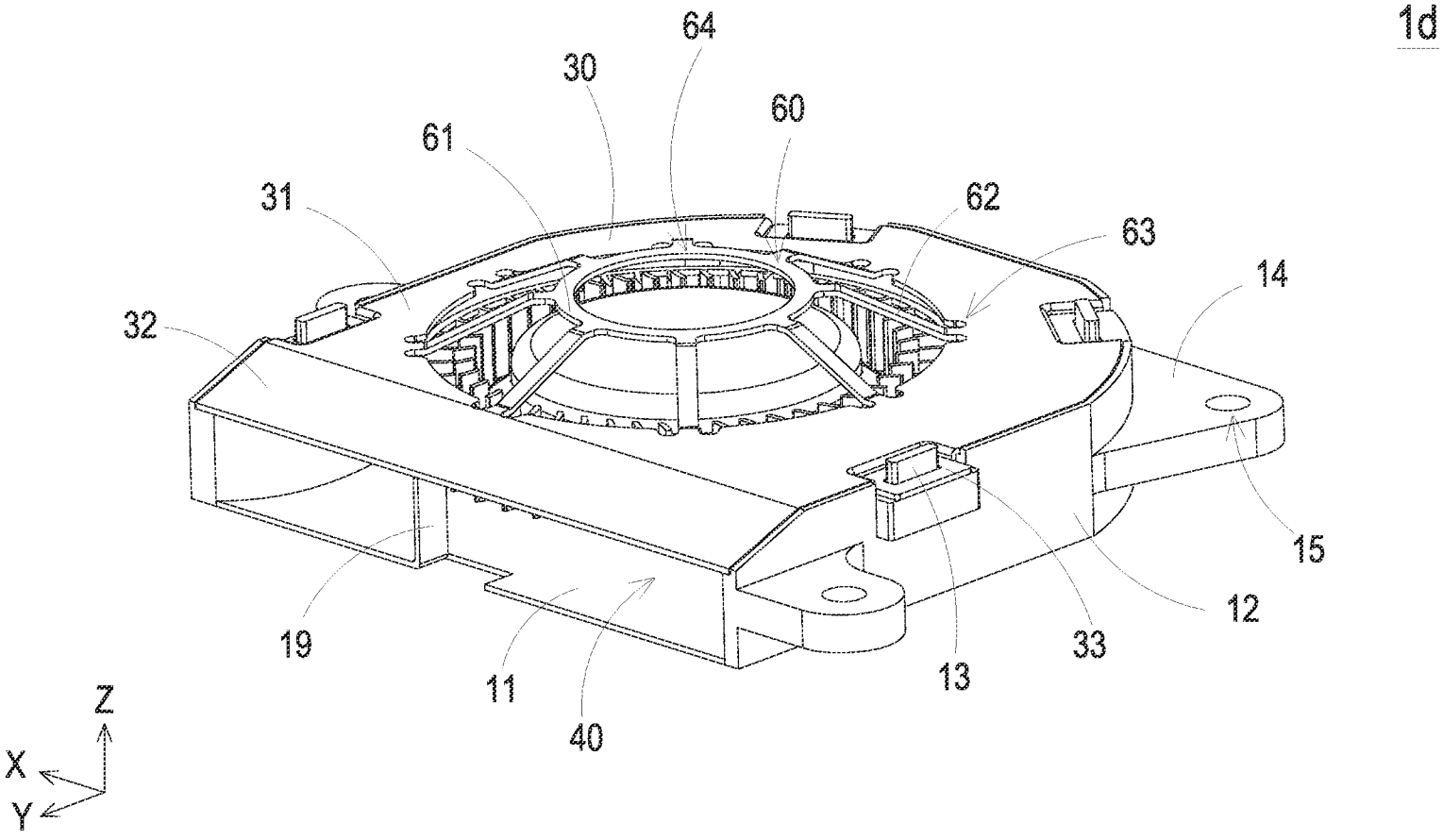
FIG. 8 is a perspective view illustrating a centrifugal fan according to a fifth embodiment of the present disclosure.

FIG. 8 is a perspective view illustrating a centrifugal fan according to a fifth embodiment of the present disclosure. In the embodiment, the structures, elements and functions of the centrifugal fan 1*d* are similar to those of the centrifugal fan 1 of FIGS. 1 to 4, and are not redundantly described herein. In the embodiment, the lower case 10 further includes a wind-guiding plate 19 extended from the bottom plate 11 of the lower case 10 toward the second plane 32 and disposed adjacent to the edge of the outlet 40 so as to provide the wind-guiding function. Preferably but not exclusively, in the embodiment, the bottom plate 11 is made of a metal material, and the bottom plate 11 is stamped to form the wind-guiding plate 19, which is extended toward the Z-axis direction and abutted against the second plane 32 of the upper case 30. Furthermore, the outlet height $H_S$ is maintained by the wind-guiding plate 19, and the collapse and the deformation caused by the external force are avoided.

Figure 9:
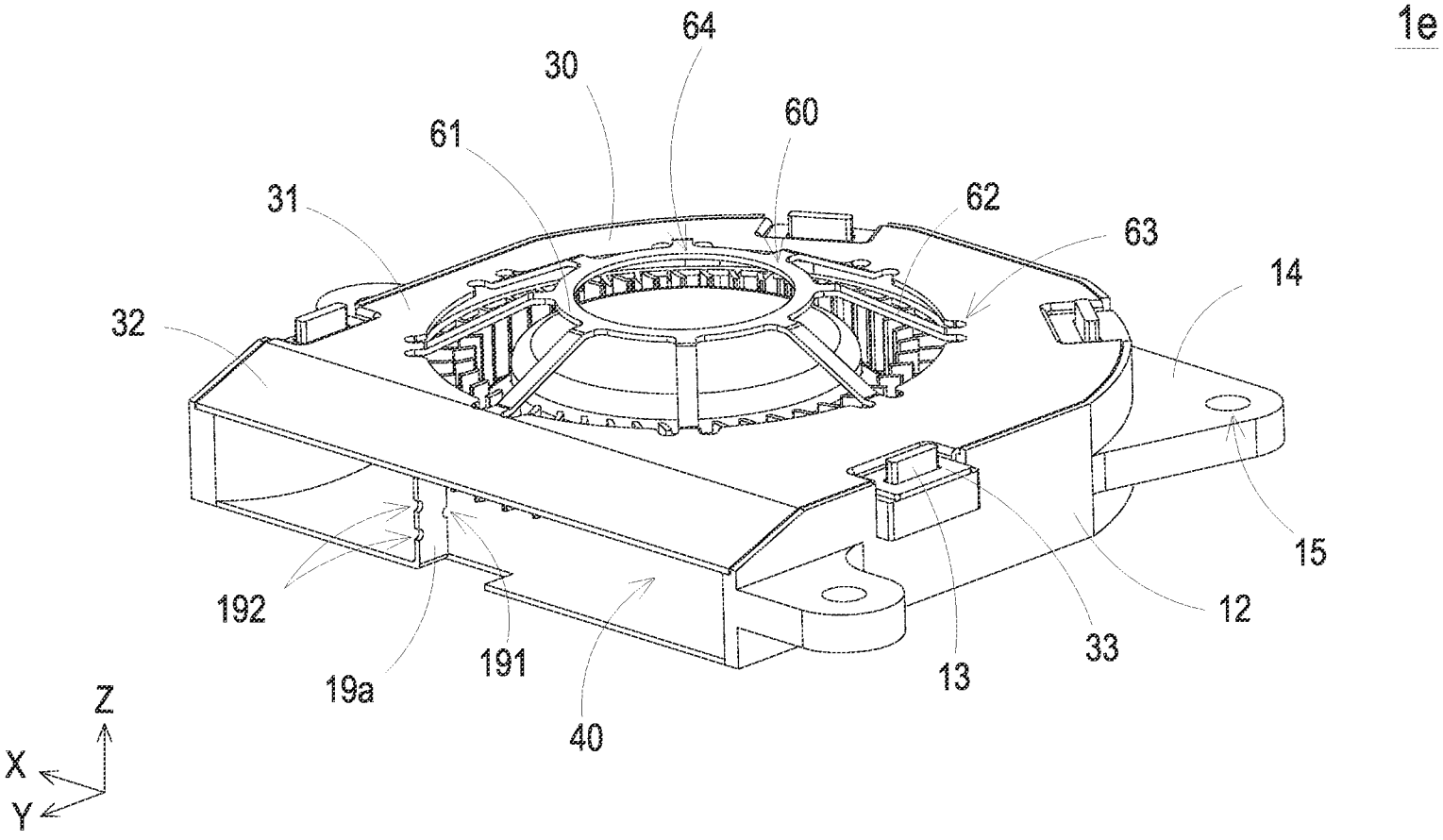
FIG. 9 is a perspective view illustrating a centrifugal fan according to a sixth embodiment of the present disclosure.

FIG. 9 is a perspective view illustrating a centrifugal fan according to a sixth embodiment of the present disclosure. In the embodiment, the structures, elements and functions of the centrifugal fan 1*e* are similar to those of the centrifugal fan 1*d* of FIG. 8, and are not redundantly described herein. In the embodiment, the lower case 10 includes a wind-guiding plate 19*a* extended from the bottom plate 11 of the lower case 10 toward the second plane 32 and disposed adjacent to the edge of the outlet 40 so as to provided the wind-guiding function. In addition, the wind-guiding plate 19*a* includes one first notch 191 and two second notches 192 disposed at two opposite lateral edges of the wind-guiding plate 19*a*, respectively. The first notch 191 is located at a windward position relative to the airflow formed from the inlet 50 to the outlet 40. The second notches 192 are located at a leeward position relative to the airflow formed from the inlet 50 to the outlet 40. With the arrangement of the first notch 191 and the second notches 192, when the wind-guiding function is provided through the wind-guiding plate 19*a*, the noise reduction function is further provided. Certainly, the number, the size and the arrangement of the first notch 191 and the second notches 192 are adjustable according to the practical requirements. Preferably but not exclusively, in other embodiments, one of the first notch 191 and the second notches 192 is omitted. The present disclosure is not limited thereto, and not redundantly described herein.

Figure 10:
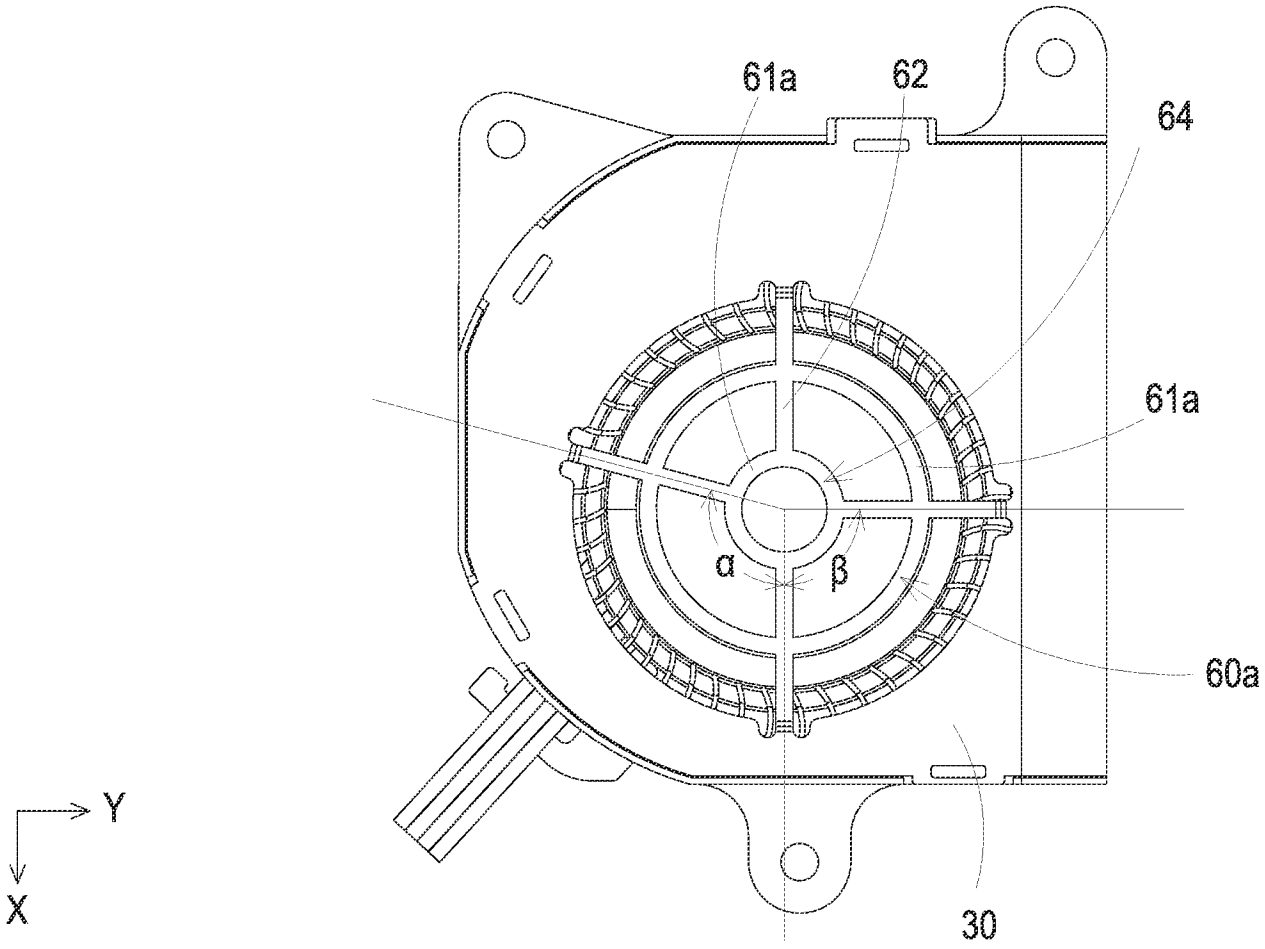
FIG. 10 is a top view illustrating a centrifugal fan according to a seventh embodiment of the present disclosure.

FIG. 10 is a top view illustrating a centrifugal fan according to a seventh embodiment of the present disclosure. In the embodiment, the structures, elements and functions of the centrifugal fan 1*f* are similar to those of the centrifugal fan 1 of FIGS. 1 to 4, and are not redundantly described herein. In the embodiment, the grille 60*a* includes four elongated ribs 62 and two circular connecting frames 61*a*. Preferably but not exclusively, two connecting frames 61*a* are arranged concentrically, and an opening 64 is formed in the center to communicate with the inlet 50. Preferably but not exclusively, the four elongated ribs 62 are connected between the two circular connecting frames 61*a* and the first plane 31 of the upper case 30. Different from the symmetrically designed grille 60 in the foregoing embodiment, in the embodiment, the grille 60*a* includes a first included angle $\alpha$ and a second included angle $\beta$, which are unequal and formed between each adjacent two of the plurality of ribs 62. Since the plurality of ribs 62 disposed between the connecting frames 61*a* and upper case 30 are designed asymmetrically, the blade-passage frequency (BPF) is further dispersed, and the purpose of optimizing the voice quality is achieved. In other embodiments, the number of the connecting frames 61*a* is adjustable according to the practical requirements, so as to increase the diversion variations of the inlet 50.

Figure 11:
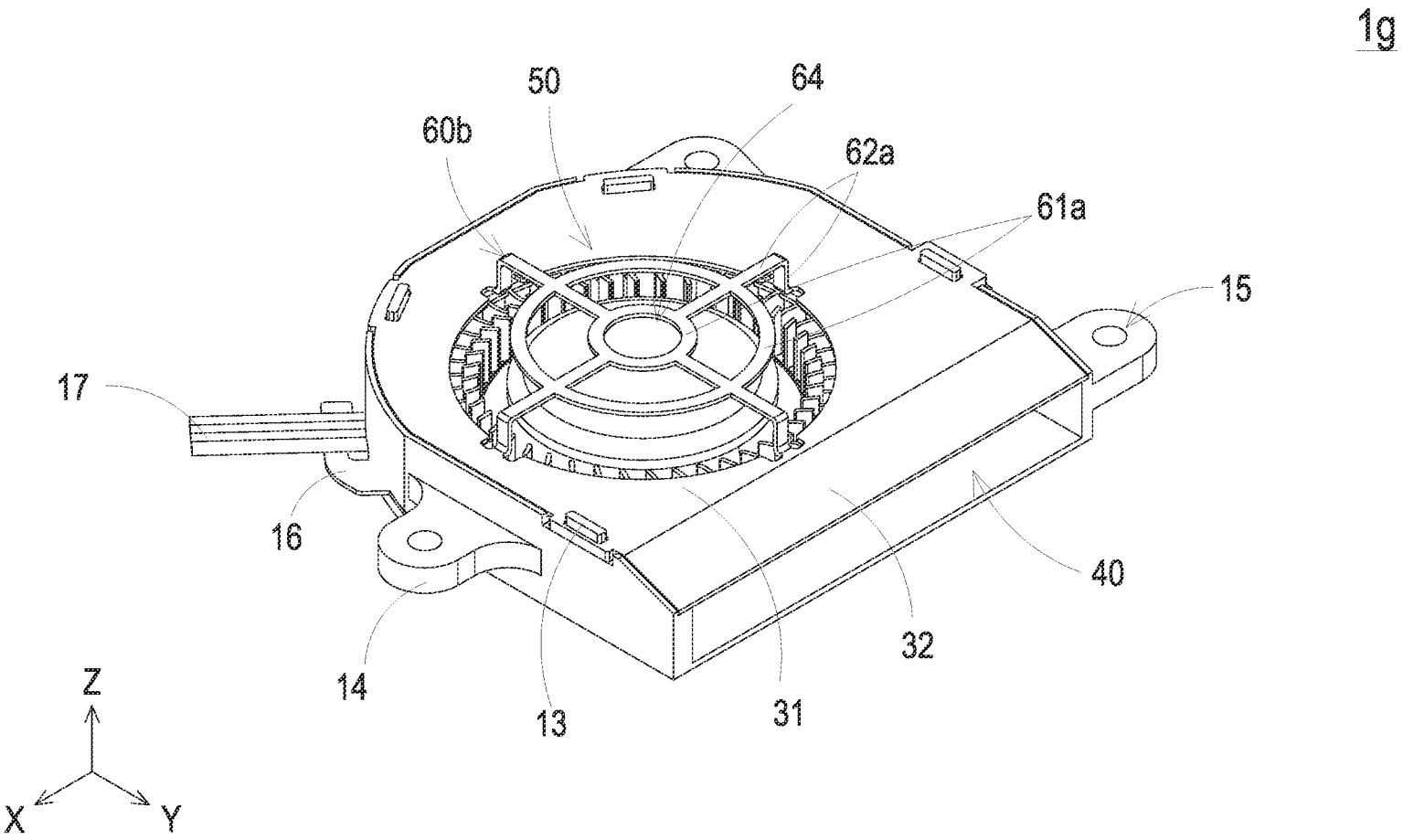
FIG. 11 is a perspective view illustrating a centrifugal fan according to an eighth embodiment of the present disclosure.

FIG. 11 is a perspective view illustrating a centrifugal fan according to an eighth embodiment of the present disclosure. In the embodiment, the structures, elements and functions of the centrifugal fan 1*g* are similar to those of the centrifugal fan 1*f* of FIG. 10, and are not redundantly described herein. In the embodiment, the grille 60*b* includes four right-angle bent ribs 62*a* and two circular connecting frames 61*a*. Preferably but not exclusively, two connecting frames 61*a* are arranged concentrically, and an opening 64 is formed in the center to communicate with the inlet 50.

Preferably but not exclusively, the four right-angle bent ribs 62*a* are connected between the two circular connecting frames 61*a* and the first plane 31 of the upper case 30. In the embodiment, the bent position of each rib 62*a* is located adjacent to the outer periphery of the inlet 50. Thereby, the space of the grille 60*b* spaced apart from the inlet 50 and the hub 21 of the impeller 20 is increased, so as to misalign to the top portion of the hub 21. Moreover, the problems of interference and abnormal noise caused by the intrusion of foreign objects are avoided.

Figure 12:
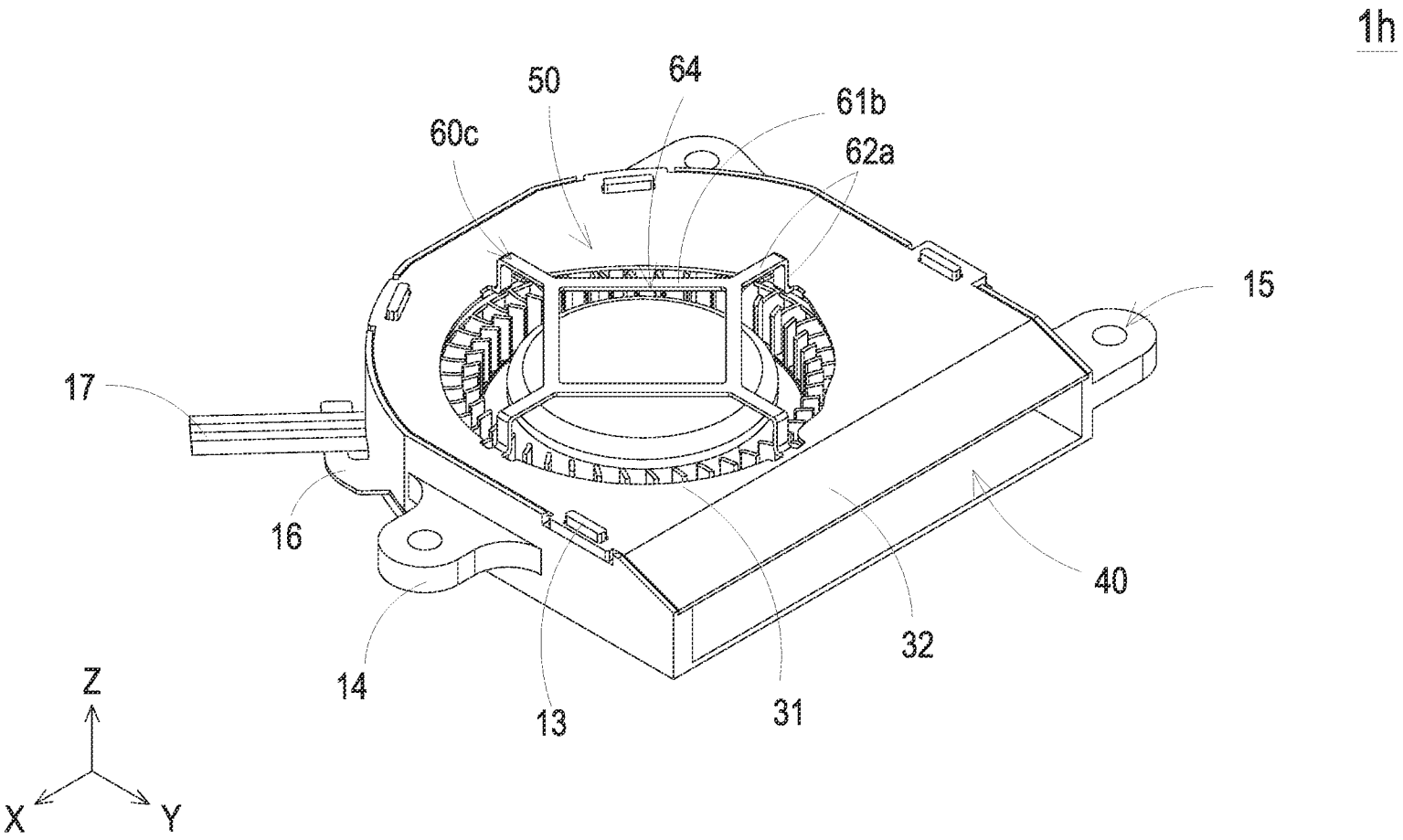
FIG. 12 is a perspective view illustrating a centrifugal fan according to a ninth embodiment of the present disclosure.

FIG. 12 is a perspective view illustrating a centrifugal fan according to a ninth embodiment of the present disclosure. In the embodiment, the structures, elements and functions of the centrifugal fan 1*h* are similar to those of the centrifugal fan 1*f* of FIG. 10, and are not redundantly described herein. In the embodiment, the grille 60*c* includes four right-angle bent ribs 62*a* and one rectangular connecting frame 61*b*. Preferably but not exclusively, an opening 64 is formed in the center of the rectangular connecting frame 61*b* to communicate with the inlet 50. Preferably but not exclusively, the four right-angle bent ribs 62*a* are connected between the rectangular connecting frame 61*b* and the first plane 31 of the upper case 30. Preferably but not exclusively, in other embodiment, the connecting frame 61*b* has a shape selected from the group consisting of hexagonal, octagonal and polygonal. The number, the size, the shape and the arrangement of the connecting frame 61*b* is adjustable according to the practical requirements, so as to increase the diversion variations of the inlet 50, increase the strength of the structure or decorate the appearance.

Figure 13:
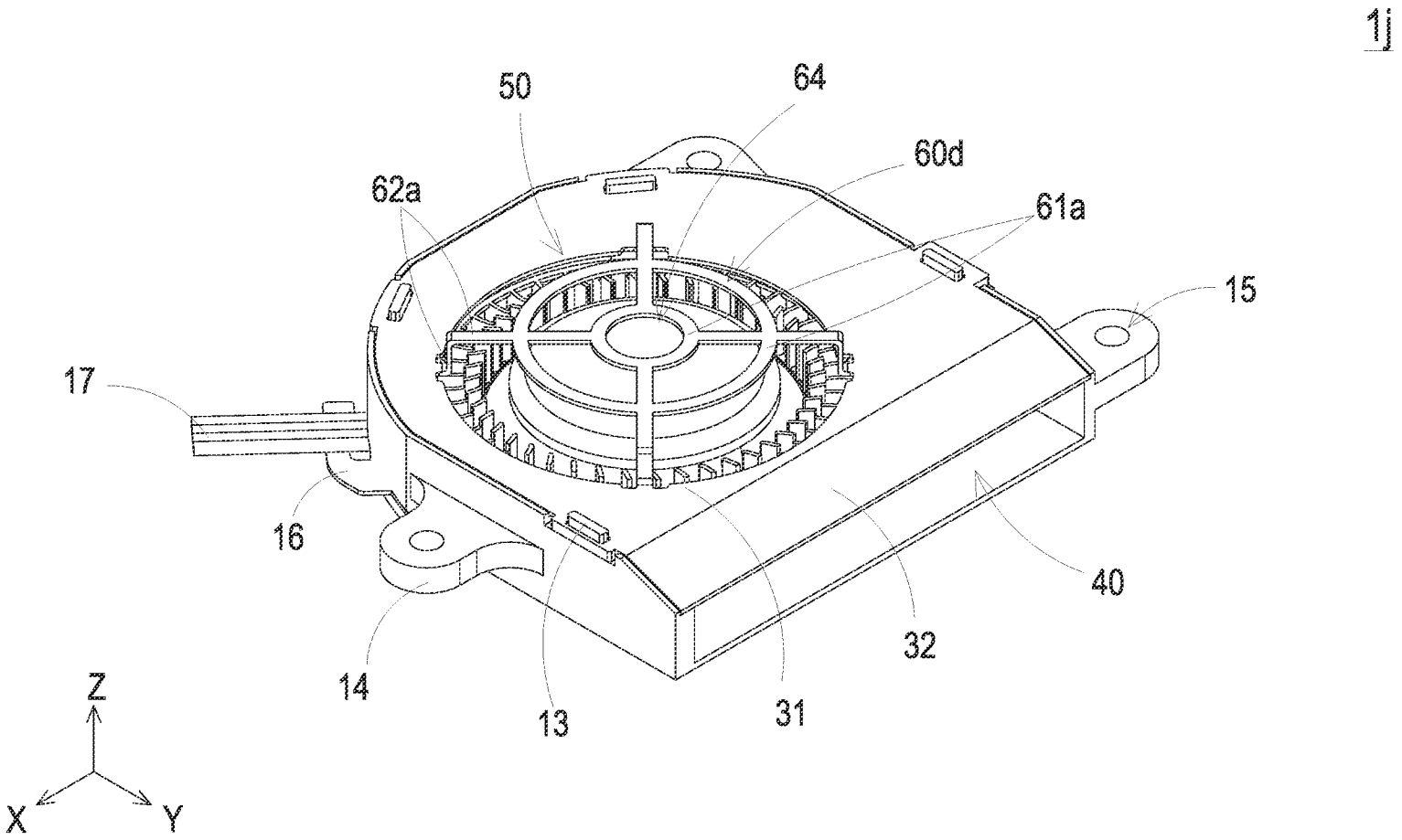
FIG. 13 is a perspective view illustrating a centrifugal fan according to a tenth embodiment of the present disclosure.

FIG. 13 is a perspective view illustrating a centrifugal fan according to a tenth embodiment of the present disclosure. In the embodiment, the structures, elements and functions of the centrifugal fan 1*j* are similar to those of the centrifugal fan 1*g* of FIG. 11, and are not redundantly described herein. In the embodiment, the grille 60*d* includes four right-angle bent ribs 62*a* and two circular connecting frames 61*a*. Preferably but not exclusively, two connecting frames 61*a* are arranged concentrically, and an opening 64 is formed in the center to communicate with the inlet 50. Preferably but not exclusively, the four right-angle bent ribs 62*a* are connected between the two circular connecting frames 61*a* and the first plane 31 of the upper case 30, and arranged equidistantly around the connecting frames 61*a*. Preferably but not exclusively, in the embodiment, the arrangement direction of the ribs 62*a* is not parallel to the airflow direction (i. e., the Y-axis direction) from the inlet 50 to the outlet 40, and is arranged in a misaligned position. It facilitates grille 60*d* to form different misalignment spaces when the centrifugal fan 1*j* is fixed to an object.

Figure 14:
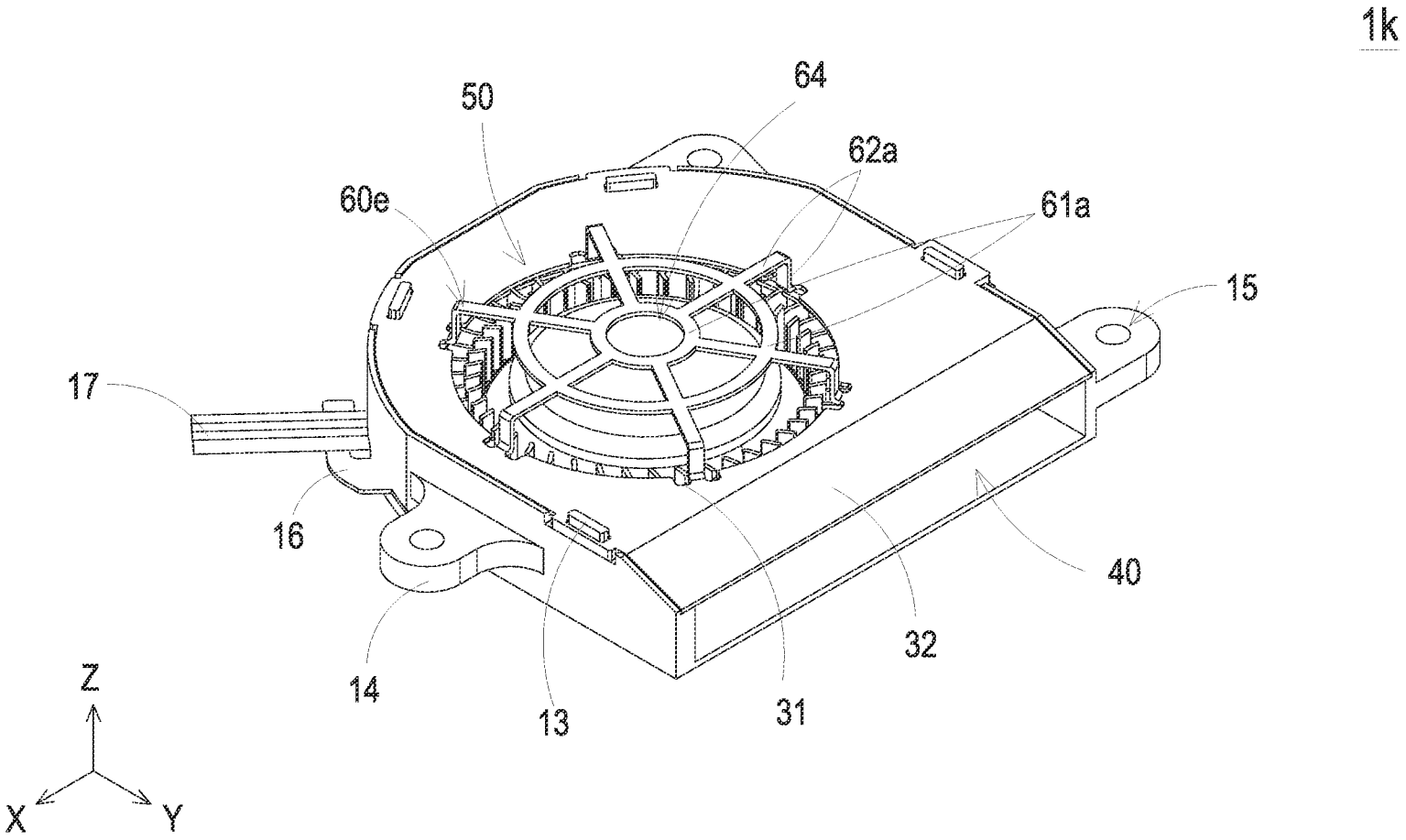
FIG. 14 is a perspective view illustrating a centrifugal fan according to an eleventh embodiment of the present disclosure.

FIG. 14 is a perspective view illustrating a centrifugal fan according to an eleventh embodiment of the present disclosure. In the embodiment, the structures, elements and functions of the centrifugal fan 1*k* are similar to those of the centrifugal fan 1*j* of FIG. 13, and are not redundantly described herein. In the embodiment, the grille 60*e* includes six right-angle bent ribs 62*a* and two circular connecting frames 61*a*. Preferably but not exclusively, two connecting frames 61*a* are arranged concentrically, and an opening 64 is formed in the center to communicate with the inlet 50. Preferably but not exclusively, the six right-angle bent ribs 62*a* are connected between the two circular connecting frames 61*a* and the first plane 31 of the upper case 30, and arranged equidistantly around the connecting frames 61*a*. Preferably but not exclusively, in other embodiment, the plurality of ribs 62*a* are designed symmetrically, and a part of the right-angle bent ribs 62*a* are replaced with the elongated ribs 62 of the foregoing embodiments. Certainly, the number and the type of the ribs 62, 62*a* are adjustable according to the practical requirements, and the present disclosure is not limited thereto. In this way, the aforementioned technical features of the centrifugal fans 1~1*k* of the present disclosure can be combined and adjustable according to the practical requirements.

In summary, the present disclosure provides a centrifugal fan having a grille. The grille is formed outside an inlet by stamping an upper case, so as to protect an impeller higher than a bottom surface of the upper case. The grille is formed by the combination of a connecting frame and a plurality of ribs. The connecting frame has a horizontal projection located within the inlet, and is corresponding to the inlet and blades of the impeller, and convexly formed to form a spacing height to protect the top portion of the hub of the impeller higher than the bottom surface of the upper case. In addition, since the connecting frame is connected to the upper case through at least three ribs, it ensures that the structure of the grille provides the sufficient compressive strength, and the reliability of the product is increased. Moreover, when the plurality of ribs are designed asymmetrically, the blade-passage frequency (BPF) is further dispersed, so as to achieve the purpose of optimizing the voice quality. On the other hand, the part of the fan frame corresponding to the outlet is designed in an inclined type, a convex type or a stepped type, so that the outlet height of the centrifugal fan is formed less than the fan-frame height of the centrifugal fan. It facilitates to increase the airflow pressure and reduce the turbulence area under the impeller. Furthermore, a wind-guiding plate and additional notches recessed thereon are disposed and corresponding to the outlet, so as to provide the wind-guiding function and the noise reduction function, respectively. In the present disclosure, an upper case, an inlet and the grille are integrally formed by stamping a metal material, and further combined with a plastic lower case through for example injection molding. With the sidewall further designed for compressing the airflow pressure of the centrifugal fan and converting it into the air volume, it helps to achieve the interface and the structure for a systematic assembling, and the assembly process is simplified. Since the grille is stamped and formed by the metal material, it easy to change the combinations of the connecting frame and the plurality of ribs, increase the diversion variations of the inlet, ensure the compressive strength of the grille, and achieve the purpose of reducing noise. Furthermore, a pair of notches are disposed at the positions where each elongated or right-angle bent rib is connected to the upper case. When the upper case is stamped to form the connecting frame and the plurality of ribs of the grille, a sufficient structural strength is maintained between the plurality of ribs and the first plane. It facilitates to increase the dimensional stability of the formation, and avoid the deformation of the plurality of ribs and the first plane due to the stamping operation. Certainly, the aforementioned technical features of the centrifugal fan of the present disclosure can be combined and adjustable according to the practical requirements.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A centrifugal fan, comprising:

a lower case having a bottom plate and a sidewall, wherein the sidewall is connected to the bottom plate;

an impeller disposed on the bottom plate; and an upper case assembled with the sidewall of the lower case to form an outlet located between the upper case and the bottom plate, wherein the upper case is formed by stamping a metal material and comprises a first plane, an inlet and a grille, the inlet is passed through the first plane and spatially corresponding to the impeller, and when the impeller is rotated, an airflow flowing from the inlet to the outlet is formed, wherein the grille is protruded outwardly from the first plane, spatially corresponding to the inlet, and comprises at least one connecting frame and a plurality of ribs, wherein a spacing height is formed between the at least one connecting frame and the inlet, and a horizontal projection of the at least one connecting frame is located within a range of the inlet, wherein each of the plurality of ribs has a first end connected to the at least one connecting frame and a second end connected to the first plane, and a pair of notches are formed and corresponding thereto, wherein the pair of notches are located at the first plane and disposed adjacent to two opposite lateral edges of the second end of the corresponding rib, respectively, wherein the upper case comprises a plurality of fastening plates disposed adjacent to an outer periphery of the upper case, and each of the fastening plates comprises a fastending hole, wherein the lower case comprises a plurality of protrusions spatially corresponding to the fastening holes of the plurality of fastening plates, wherein the plurality of protrusions are passed through and engaged with the fastening holes of the corresponding fastening plate, so that the upper case and the lower case are assembled and fastened to each other.

2. The centrifugal fan according to claim 1, wherein the impeller comprises a hub disposed on the bottom plate, and the top portion of the hub is higher than a bottom surface of the upper case.

3. The centrifugal fan according to claim 1, wherein the lower case and the upper case are assembled to form a fan-frame height, and the spacing height is less than the fan-frame height.

4. The centrifugal fan according to claim 3, wherein an outlet height is formed at the outlet of the centrifugal fan, and the outlet height is less than the fan-frame height.

5. The centrifugal fan according to claim 3, wherein the upper case comprises a second plane connected between the first plane and the outlet, and forming an inclination angle with respect to the first plane, wherein the inclination angle is less than or equal to 75 degrees.

6. The centrifugal fan according to claim 5, wherein the lower case further comprises an inclined plane spatially corresponding to the second plane, wherein the inclined plane is connected to the bottom plate and inclined toward the upper case along a direction from the inlet to the outlet.

7. The centrifugal fan according to claim 5, wherein the lower case further comprises a convex structure spatially corresponding to the second plane, wherein the convex structure is connected to the bottom plate, and a middle section of the convex structure is protruded toward the upper case.

8. The centrifugal fan according to claim 5, wherein the lower case further comprises a stepped structure spatially corresponding to the second plane, wherein the stepped structure is connected to the bottom plate, and the stepped structure is close to the second plane of the upper case relative to the bottom plate.

9. The centrifugal fan according to claim 1, wherein the number of the plurality of ribs is N, and N is an integer and greater than or equal to 3.

10. The centrifugal fan according to claim 1, wherein the plurality of ribs are connected to the first plane to form at least one first bending angle and at least one second bending angle, and the at least one first bending angle and the at least one second bending angle are unequal.

11. The centrifugal fan according to claim 1, wherein the lower case comprises a wind-guiding plate extended from the bottom plate toward the second plane and disposed adjacent to the outlet.

12. The centrifugal fan according to claim 11, wherein the wind-guiding plate comprises at least one first notch and at least one second notch disposed at two opposite lateral edges of the wind-guiding plate, respectively.

13. The centrifugal fan according to claim 1, wherein the at least one connecting frame comprises two circular connecting frames arranged concentrically.

14. The centrifugal fan according to claim 1, wherein at least one first included angle and at least one second included angle are formed between each adjacent two of the plurality of ribs, and the at least one first included angle and the at least one second included angle are unequal.

15. The centrifugal fan according to claim 1, wherein the at least one connecting frame comprises an opening in fluid communication with the inlet, and the at least one connecting frame has a shape selected from the group consisting of circular, rectangular, hexagonal, octagonal and polygonal.

16. The centrifugal fan according to claim 1, wherein the plurality of ribs are one selected from the group consisting of an elongated rib, a right-angle bent rib and a combination thereof.

17. The centrifugal fan according to claim 1, wherein the plurality of ribs are connected between the connecting frame and the first plane of the upper case, and are arranged equidistantly around the connecting frame.

18. The centrifugal fan according to claim 1, wherein the lower case is made of a plastic material, and the upper case and the lower case are combined by injection molding.

19. The centrifugal fan according to claim 1, wherein the lower case comprises a plurality of attachment portions protruded outwardly from the sidewall, and each of the attachment portions comprises a corresponding screw hole configured to fix the centrifugal fan on an object.

* * * * *